US011781738B2

(12) United States Patent
Seronveaux et al.

(10) Patent No.: US 11,781,738 B2
(45) Date of Patent: Oct. 10, 2023

(54) LUMINAIRE SYSTEM WITH MOVABLE MODULES

(71) Applicant: Schreder S.A., Brussels (BE)

(72) Inventors: Laurent Seronveaux, Bellaire (BE); Roxane Caprara, Neupre (BE)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 17/417,934

(22) PCT Filed: Dec. 24, 2019

(86) PCT No.: PCT/EP2019/087016
§ 371 (c)(1),
(2) Date: Jun. 24, 2021

(87) PCT Pub. No.: WO2020/136197
PCT Pub. Date: Jul. 20, 2020

(65) Prior Publication Data

US 2022/0090764 A1 Mar. 24, 2022

(30) Foreign Application Priority Data

Dec. 24, 2018 (NL) ..... 2022297

(51) Int. Cl.
*F21V 14/06* (2006.01)
*F21S 2/00* (2016.01)
(Continued)

(52) U.S. Cl.
CPC ..... *F21V 14/06* (2013.01); *F21S 2/005* (2013.01); *F21V 5/007* (2013.01); *F21V 17/02* (2013.01);
(Continued)

(58) Field of Classification Search
CPC ..... F21V 14/06; F21V 5/007; F21V 17/02; F21V 23/004; F21S 2/005
See application file for complete search history.

(56) References Cited

U.S. PATENT DOCUMENTS 8,657,464 B2 * 2/2014 Lundberg ..... F21S 10/023 362/232
9,250,417 B2 * 2/2016 Schaffer ..... G03F 7/70316
(Continued)

FOREIGN PATENT DOCUMENTS

EP 3165818 A1 5/2017
WO 2017/191954 A1 9/2017

OTHER PUBLICATIONS

PCT International Search Report and Written Opinion, Application No. PCT/EP2019/087016, dated Feb. 6, 2020, 11 pages.

*Primary Examiner* — Tracie Y Green
*Assistant Examiner* — Michael Chiang
(74) *Attorney, Agent, or Firm* — McDonnell Boehnen Hulbert & Berghoff LLP

(57) ABSTRACT

Example embodiments relate to luminaire systems with movable modules. One example luminaire system includes a support structure. The luminaire system also includes a plurality of light sources arranged on the support structure. Additionally, the luminaire system includes at least a first and second optical module. The first optical module is provided with at least one first optical element and the second optical module is provided with at least one second optical element. The first and second optical module are configured for being interlocked with respected to each other in a moving direction. Further, the luminaire system includes a moving means configured to move the first optical module relative to the support structure in the moving direction, such
(Continued)

that a position of the first and second optical module with respect to the support structure is changed.

19 Claims, 7 Drawing Sheets

(51) Int. Cl.
*F21V 5/00* (2018.01)
*F21V 17/02* (2006.01)
*F21V 23/00* (2015.01)
*F21Y 115/10* (2016.01)

(52) U.S. Cl.
CPC ..... *F21V 23/004* (2013.01); *F21Y 2115/10* (2016.08)

(56) References Cited

U.S. PATENT DOCUMENTS 10,408,433 B2 * 9/2019 Casper ..... F21V 9/38
10,437,030 B2 * 10/2019 Dross ..... G02B 19/0028
10,544,920 B2 * 1/2020 Jordan ..... F21V 17/002
10,816,165 B2 * 10/2020 McCracken, Jr. ..... F21V 13/04
2006/0002110 A1 * 1/2006 Dowling ..... F21V 23/005 362/249.05
2008/0273324 A1 * 11/2008 Becker ..... F21V 14/06 362/237
2009/0009997 A1 * 1/2009 Sanfilippo ..... F21V 21/005 362/244
2010/0061090 A1 * 3/2010 Bergman ..... F21V 5/007 362/231
2011/0063836 A1 * 3/2011 Salm ..... F21V 13/04 359/811
2011/0280018 A1 * 11/2011 Vissenberg ..... F21V 5/007 362/277
2012/0121244 A1 * 5/2012 Stavely ..... G02B 3/08 362/232
2012/0320585 A1 12/2012 Lin et al.
2013/0301264 A1 * 11/2013 Van Gompel ..... F21V 17/005 362/236
2014/0168988 A1 * 6/2014 Petersen ..... H01L 33/505 362/293
2014/0185285 A1 * 7/2014 Jorgensen ..... G02B 19/0066 362/232
2015/0211708 A1 * 7/2015 Stavely ..... G02B 3/0056 362/231
2016/0018081 A1 * 1/2016 Kadoriku ..... F21S 41/43 362/280
2016/0215961 A1 * 7/2016 Kjeldsen ..... F21V 13/02
2018/0087748 A1 * 3/2018 Gladden ..... G02B 19/0028
2018/0245776 A1 * 8/2018 Gladden ..... F21V 7/04
2019/0093859 A1 * 3/2019 Peard ..... G02B 6/0008
2019/0376663 A1 * 12/2019 Gladden ..... F21V 5/008

* cited by examiner

LUMINAIRE SYSTEM WITH MOVABLE MODULES

CROSS-REFERENCE TO RELATED APPLICATIONS

The present application is a national stage entry of PCT/EP2019/087016 filed Dec. 24, 2019, which claims priority to NL 2022297 filed Dec. 24, 2018, the contents of each of which are hereby incorporated by reference.

FIELD OF INVENTION

The present invention relates to the field of luminaire systems, in particular outdoor luminaire systems. Particular embodiments relate to luminaire systems with adjustable photometry.

BACKGROUND

In existing luminaire systems it is common to design a specific printed circuit board (PCB) serving as a support for a plurality of light sources together with a specific optical element plate for each luminaire application, e.g. a pedestrian road, a highway, etc. The design of the PCB and the optical element plate depend notably on the desired light distribution on the surface to be illuminated, i.e. the desired shape of the light onto the illuminated surface. Such approach is costly, time consuming and requires extensive stock keeping.

In prior art solutions, to address the above mentioned problems, optical elements may be provided which are adjustable on an individual basis or within relatively restricted boundaries. Also, it is known to provide a luminaire system in which the position of the optical elements can be adjusted relative to the printed circuit board. However, the existing solutions are still limited in terms of flexibility, especially when it is desirable to be able to build both large and small luminaire systems with a limited amount of different components.

SUMMARY

The object of embodiments of the invention is to provide a luminaire system with movable optical elements which can be easily built in various sizes. More in particular, embodiments of the invention aim to provide a luminaire system of which the size can be easily adjusted on site and/or at the factory.

According to a first aspect of the invention, there is provided a luminaire system comprising a support structure, a plurality of light sources arranged on the support structure, at least a first and a second optical module, and a moving means. The first optical module is provided with at least one first optical element, and the second optical module is provided with at least one second optical element. The first and second optical module are configured for being interlocked with respect to each other in a moving direction. The moving means is configured to move the first optical module relative to the support structure in the moving direction, such that the position of the first and second optical module with respect to the support structure is changed.

By providing at least two interlockable optical modules, the size of the luminaire system can be easily adapted. Indeed, it is possible to provide two or more optical modules which are interlocked, whilst the moving means have to be connected to only one optical module or to a frame portion realising the interlocking. Further, the moving means will allow the light distribution to be varied by adjusting the position of the at least two optical modules. Thus, embodiments of the invention provide a modular luminaire system with adjustable photometry.

Preferably, each optical module is an integrally formed element in which the at least one optical element is integrally formed. Also, the interlocking features may be integrally formed elements. More preferably, each optical module is moulded in one piece with the at least one optical element and at least one interlocking element integrated in said piece.

In an exemplary embodiment, each or at least one optical module comprises a plurality of optical elements, e.g. a plurality of lenses. For example, each or at least one optical module may comprise a two dimensional array of optical elements with at least two rows and at least two columns.

Preferably, each optical module is formed as a plate in which the one or more optical elements are integrated. A plate-like structure has the advantage that it can be easily supported on the support structure. More preferably, a plurality of optical elements, such as a plurality of lens elements, is integrated in the plate.

The one or more first optical elements and the one or more second optical elements may be any one of the following: a lens, a reflector, a backlight, a prism, a collimator, a diffusor, and the like. Also, an optical element may be combining multiple optical functions, e.g. a lens and a reflector function, or a collimator and a reflector function. The one or more first optical elements may be the same or different from the one or more second optical elements. Also, an optical module may comprise identical optical elements or may comprise different optical elements. This will allow combining different optical functions in the same luminaire in a modular manner. For example, a first subset of light sources may be provided with a first optical module with first optical elements of a first type, and a second subset of light sources may be provided with a second optical module with second optical elements of a second type. This allows choosing a suitable optical module in function of the position of the light sources in the luminaire system. For example, light sources near the periphery of the support structure may be provided with a different optical module compared to light sources provided in the centre of the support structure, and/or light sources near the luminaire pole may be provided with a different optical module compared to light sources provided near a front end of a luminaire head of the luminaire system.

According to an exemplary embodiment, an edge of the first optical module has a shape which is complementary to an edge of the second optical module, such that said edges can cooperate in an interlocking manner More in particular, the edges of the first and second optical module may cooperate as two pieces of a two dimensional puzzle. For example, the edge of the first optical module may be provided with a protruding portion, whilst the edge of the second optical module may be provided with a recess configured to receive the protruding portion. The shape of the protruding portion and the recess is such that an interlocking between the first and the second optical module is achieved.

Preferably, the first and the second optical module are configured to cause an interlocking in two dimensions in a plane parallel to the support structure. For example, seen in a plane parallel to the support structure, and edge of the first optical module may have a shape which is complementary to an edge of the second optical module, wherein the shape is such that an interlocking is caused. For example, the shape may be a dovetail shape.

In a further developed embodiment, the first and second optical module may be configured to cause an interlocking in three dimensions. For example, the shape of the edges of the first and the second module may be such that an interlocking is obtained in a plane parallel to the support structure, as well as in a plane perpendicular to the support structure.

In an exemplary embodiment, each optical element of the first and second optical module is associated with a light source of the plurality of light sources. However, it is also possible to associate a single optical element to a plurality of light sources, or to associate multiple optical elements to a single light source. In the context of the present application, a light source may comprise a single light emitting diode (LED), or a plurality of LEDs. Further, the light sources may be the same or different. Also, the optical elements may be the same or different.

In a preferred embodiment, the support structure comprises at least one printed circuit board (PCB). There may be provided a single PCB for a plurality of optical modules. For example, a single PCB may be combined with two, three, four or more optical modules. However, in other embodiments, the support structure may comprise a plurality of PCBs. The plurality of PCBs may be interconnected. For example, the plurality of PCBs may be interlocked with respect to each other in similar ways as disclosed for the optical modules, in particular interlocked in a direction parallel to the moving direction.

In a possible embodiment, the first and second optical module are arranged to move in contact with the support structure, and more preferably with the at least one PCB. Alternatively, the first and second optical module may be arranged to move at a distance of the support structure, and more preferably the at least one PCB. To that end, the at least one PCB may be provided with distance elements on which the first and second optical module are movably supported. Optionally, a surface of the first and second optical module facing the at least one PCB may be provided with tracks or guides cooperating with the distance elements. Such tracks or guides may be formed integrally with the rest of the optical module. Optionally, the distance elements may be adjustable in order to adjust the distance between the PCB and the optical module. For example, the distance elements may comprise a screw thread cooperating with a bore arranged in/on the PCB.

According to an exemplary embodiment, the first and the second optical module are interlocked with a frame portion such that said first and second optical module are interlocked with respect to each other in a moving direction. In other words, the frame portion may form the interlocking connection between the first and the second optical module, see also the embodiment of FIGS. 7B and 7C. The moving means may then be connected to the frame portion in order to move the first and second optical module.

According to another exemplary embodiment, the moving means is directly connected to the first or second optical module. Because the first optical module is interlocked directly and/or via frame portion with the second optical module, a moving of the first optical module will automatically entrain a movement of the second optical module.

According to yet another exemplary embodiment, the first optical module is connected, e.g. interlocked, to a frame portion, the second optical module is interlocked with the first optical module, and the moving means is connected to the frame portion in order to move the first and second optical module. In other words, in some embodiments, it may be advantageous to insert a frame portion between one of the optical modules and the moving means to obtain a suitable connection.

According to a further developed embodiment, the luminaire system comprises a further optical module provided with at least one further optical element, and a further moving means configured to move the further optical module relative to the support structure in a further moving direction. In other words, it is possible to add one or more further optical modules which are associated with a further moving means. In that manner, a first set of optical modules including the first and the second optical module may be moved independently from a further set comprising the one or more further optical modules. When more than one further optical module is provided, those further optical modules may also be configured for being interlocked with respect to each other.

It is noted that in the context of the application "a moving means" may refer to one or more actuators to move the first optical module. The moving may be a translation and/or a rotation and, more generally the first optical module and any modules connected thereto may be moved along any trajectory using any suitable moving means.

In an exemplary embodiment, the plurality of light sources comprises at least eight light sources, and the light sources are arranged in a two dimensional array of at least two rows and at least four columns. Similarly, the plurality of optical elements may be arranged in an array of at least two rows and at least two columns.

According to a preferred embodiment, the luminaire system further comprises a driver configured to drive the plurality of light sources, and optionally also configured to drive the moving means. The luminaire system may further comprise a light dimmer configured to vary the light intensity of some or all of the plurality of light sources. The dimming level may be different from one light source to another.

According to an exemplary embodiment, the plurality of light sources may comprise a plurality of first light sources having a first colour temperature and a plurality of second light sources having a second colour temperature different from the first colour temperature. The optical modules may be associated with the plurality of first and second light sources. The plurality of first light sources may be driven according to a first profile, and the plurality of second light sources may be driven according to a second profile, such that either the first plurality of light sources is on or the second plurality of light sources is on, or such that they are both on. In that manner not only the light distribution may be changed but also the colour temperature of the light. Colour temperature is meaningful for light in a range going from red to orange to yellow to white to blueish white. Colour temperatures over 5000 K are called "cool colours" (bluish), while lower colour temperatures (2700-3000 K) are called "warm colours" (yellowish). Embodiments of the luminaire system make it possible to adapt its light colour temperature, e.g. depending on the passage of an object such as a cyclist, a pedestrian, a nocturnal animal such as a bat or a frog, or in function of the time of the day, or in function of a weather condition.

An object of embodiments according to a second aspect of the invention, is to provide a luminaire system and a method for manufacturing such a luminaire system which allow to easily adjust the number of light sources and optical elements in the luminaire system.

According to the second aspect, a luminaire system comprises a support structure, a plurality of light sources arranged on the support structure, and an optical structure provided with a plurality of optical elements. The support structure and/or the optical structure is an integral plate-like structure comprising a plurality of plate-like elements having adjacent edges which are interconnected with each other via one or more integral interconnecting elements, said one or more integral interconnecting elements being configured for allowing and guiding a separating of adjacent plate-like elements.

It is noted that it is possible to combine the support structure with integrated interconnecting elements with any one of the previously described optical modules instead of with the optical structure. Also, it is possible to combine the optical structure with integrated interconnecting elements with any one of the support structures described above. Further, the above described preferred features of the support structure and of the optical modules according to the first aspect may be present in the support structure and the optical structure of the second aspect.

An interconnecting element may be a bar- or rod-shaped element. Alternatively, an interconnecting element may be a thin plate having a thickness which is significantly smaller than the thickness of the plate-like elements of the integral support structure or optical structure.

Preferably, an edge of a plate like element has a surface area of which less than 20% is interconnected by the one or more interconnecting elements such that an easy cutting or breaking of the interconnecting elements is possible.

In an exemplary embodiment, the system comprises a moving means configured to move the optical structure relative to the support structure, such that a position of the optical structure with respect to the support structure can be changed.

According to a further aspect, there is provided a method for manufacturing a support structure for a luminaire system according to any one of the above described embodiments, comprising cutting a PCB such as a PCBA, into a plurality of plate-like elements such that adjacent edges of the plate-like elements are interconnected with each other via one or more integral interconnecting elements, and optionally removing one or more plate-like elements by breaking one or more interconnecting elements in order to obtain a support structure with a desired number of plate-like elements.

According to another aspect, there is provided a method for manufacturing an optical structure for a luminaire system according to any one of the above described embodiments, comprising cutting an optical base structure provided with a plurality of optical elements, into a plurality of plate-like elements, such that adjacent edges of the plate-like elements are interconnected with each other via one or more integral interconnecting elements, and optionally removing one or more plate-like elements from the optical base structure by breaking or cutting one or more interconnecting elements in order to obtain an optical structure with a desired number of plate-like elements. Each plate-like element corresponds with an optical module and may be provided with one or more optical elements.

According to yet another aspect, there is provided a method for manufacturing an optical structure for a luminaire system according to any one of the above described embodiments, said method comprising moulding an integral optical base structure with a plurality of plate-like elements each provided with one or more integral optical elements, such that adjacent edges of the plate-like elements are interconnected with each other via one or more integral interconnecting elements, and optionally removing one or more plate-like elements from the optical base structure by breaking or cutting one or more interconnecting elements in order to obtain an optical structure with a desired number of plate-like elements.

According to an exemplary embodiment, the luminaire system further comprises a controlling means configured to control the moving means, such that the movement of the first and second optical module relative to the support structure is controlled. In this manner, moving the first and second optical module relative to the support structure with the moving means is more precise for the positioning of the plurality of optical elements relative to the plurality of light sources. For example, the controlling means may be configured to control the moving means to position the plurality of optical elements relative to the support structure in a plurality of positions resulting in a plurality of lighting patterns on a surface. It is noted that either the plurality of optical modules or the support structure may be moved. In particular embodiments, both the plurality of optical modules and the support structure may be moved, independently from each other.

According to a preferred embodiment, an optical element, e.g. a lens element has an internal dimension D seen in a movement direction of the moving means; and the controlling means is configured to control the moving means such that the first and second optical module are moved over a distance below 90% of the internal dimension D of the optical element, preferably below 50% of the internal dimension D. In an embodiment with a lens element, the internal dimension D corresponds to the distance between the boundaries of a cavity facing the corresponding light source as measured in the moving direction.

In this way, changes in the light distribution are achieved by changes in the profile or optical properties of the optical element in the direction of movement. Movements would only need to be limited such that the light emitted by the plurality of light sources is distributed in an adequate manner by the corresponding optical elements. The mentioned adequate manner can correspond to a movement whose distance is below 90%, preferably below 50%, of the internal dimension D of the optical element such that the plurality of light sources can be kept in correspondence with their respective optical elements. In another embodiment, the luminaire system comprises more optical elements than light sources, and the controlling means is configured to control the moving means such that the first and second optical module are moved relative to the support structure in such a way that a given light source is moved from one optical element to another optical element.

In the context of the invention, a lens element may include any transmissive optical element that focuses or disperses light by means of refraction. It may also include any one of the following: a reflective portion, a backlight portion, a prismatic portion, a collimator portion, a diffusor portion. For example, a lens element may have a lens portion with a concave or convex surface facing a light source, or more generally a lens portion with a flat or curved surface facing the light source, and optionally a collimator portion integrally formed with said lens portion, said collimator portion being configured for collimating light transmitted through said lens portion. Also, a lens element may be provided with a reflective portion or surface or with a diffusive portion.

Alternatively, the one or more optical elements could be a transparent or translucent cover having varying optical properties (e.g. variation of thickness, transparency, diffusivity, reflectivity, refractivity, colour, etc.) along the movement direction of the second support.

The one or more first optical elements and/or the one or more second optical elements may also comprise one or more light shielding structures complying with a certain glare classification, e.g. the G classification defined according to the CIE115:2010 standard and the G* classification defined according to the EN13201-2 standard. The light shielding structures may be configured for reducing a solid angle of light beams of the plurality of light sources by cutting off or reflecting light rays having a large incident angle, thereby reducing the light intensities at large angles and improving the G/G* classification of the luminaire system.

It is noted that multiple layers of optical elements may be arranged on the support. For example, a first layer with at least two optical modules each comprising a lens element and a second layer with one or more light shielding structure. The one or more light shielding structures may be an integral part of the at least two optical modules or may be one or more separate modules. When they are provided as one or more separate modules, the one or more light shielding modules may be mounted on the at least two optical modules of the first layer. In such an embodiment, the at least two optical modules of the first layer and the at least one shielding structure may be moved together relative to the support structure.

According to one embodiment, the light shielding structures may comprise a plurality of closed reflective barrier walls, each having an interior bottom edge disposed on the at least two optical modules with lens elements, an interior top edge at a height above said interior bottom edge, and a reflective surface connecting the interior bottom edge and the interior top edge and surrounding one or more lenses of said at least two optical modules. The height may be at least 2 mm, preferably at least 3 mm. The interior bottom edge defines a first closed line and the interior top edge defines a second closed line. Preferably, the first closed line and the second closed line comprising at least one curved portion over at least 15%, preferably over at least 20%, more preferably over at least 25%, of a perimeter of said first closed line and a perimeter of said second closed line, respectively. The reflective surface is configured for reducing a solid angle Ω of light beams emitted through the one or more associated lenses of said plurality of lenses. Exemplary embodiments of shielding structures are disclosed in patent application NL2023295 in the name of the applicant which is included herein by reference.

According to another embodiment, the light shielding structures may comprise a plurality of reflective barriers, each comprising a base surface disposed on the at least two optical modules, a top edge at a height above said base surface, and a first reflective sloping surface connecting the base surface and the top edge and facing one or more lenses of the at least two optical modules. The first reflective sloping surface may be configured for reflecting light rays emitted through one or more first lenses of the at least two optical modules having a first incident angle with respect to an axis substantially perpendicular to the base surface between a first predetermined angle and 90°, with a first reflection angle with respect to said axis smaller than 60°. The first predetermined value may be a value below 90°. In other words, when the first incident angle is between the first predetermined value and 90°, the first reflective sloping surface reflects the incident ray such that the reflected ray has a reflection angle with respect to said axis smaller than 60°. According to an embodiment, at least one reflective barrier of the plurality of reflective barriers further comprises a second reflective sloping surface opposite the first reflective sloping surface, configured for reflecting light rays emitted through one or more second lenses adjacent to the one ore more first lenses associated with the first reflective sloping surface, having a second incident angle with respect to an axis substantially perpendicular to the base surface comprised between a second predetermined angle and 90°, with a second reflection angle with respect to said axis smaller than 60°. Exemplary embodiments of shielding structures are disclosed in patent application PCT/EP2019/074894 in the name of the applicant which is included herein by reference.

Further, different light sources may be arranged on the support structure. For example, a first light source may have a first colour temperature and a second light source may have a second colour temperature. Further, different optical elements may be arranged over different light sources. For example, the optical elements may have different shapes, or may comprise a transparent or translucent portion having different optical properties (e.g. differences of thickness, transparency, diffusivity, reflectivity, refractivity, colour, etc.) along the movement direction of the second support.

According to a preferred embodiment, the luminaire system further comprises a guiding means configured for guiding the movement of the optical modules with respect to the support structure. For example, the guiding means may comprise a first sliding guide and a second sliding guide parallel to the first sliding guide, said first and second sliding guide extending in a direction of movement of the moving means.

According to an exemplary embodiment, the luminaire system further comprises a sensing means. The sensing means may comprises any one or more of a presence sensor, an ambient light sensor, an ambient visibility sensor, a traffic sensor, a dust particle sensor, a sound sensor, an image sensor such as a camera, an astroclock, a temperature sensor, a humidity sensor, a ground condition measurement sensor such as a ground reflectivity sensor, a lighting pattern sensor, a speed detection sensor.

According to a preferred embodiment, the luminaire system further comprises a sensing means configured to acquire a measure for a position of the first and second optical module relative to the support structure, and the controlling means is configured to control the moving means in function of the acquired measure. In this manner, the sensing means can obtain the position and a specific desired light distribution corresponding to a specific position of the first and second optical module can be achieved by the movement of the first and second optical module controlled by the controlling means.

According to an exemplary embodiment, the luminaire system further comprises an environment sensing means configured to detect environmental data; and the controlling means is configured to control the moving means in function of the detected environmental data. The environment sensing means may be provided in a luminaire head of the luminaire system or to another component of the luminaire system, e.g. to a pole of the luminaire, or in a location near the luminaire. In this way, the environment sensing means can detect environmental data, e.g. luminosity, visibility, weather condition, sound, dynamic object (presence and/or speed), ground condition such as a ground reflectivity property, humidity, temperature, lighting pattern, time of the day, day of the year, of the surroundings of the luminaire system. Controlling the moving means in function of the detected environmental data may allow changing the light distribution, and thus the lighting pattern of the luminaire system in accordance with the detected environmental data in a more dynamic manner, e.g. compensating luminosity depending on weather or time of the day, changing to a lighting pattern more adapted for a passing cyclist.

According to a preferred embodiment, the luminaire system further comprises a pattern sensing means, e.g. a camera, configured to acquire a measure for a lighting pattern produced by the luminaire system; and the controlling means is configured to control the moving means in function of the acquired measure. The pattern sensing means may be provided to a luminaire head of the luminaire system or to another component of the luminaire system, e.g. to a pole of the luminaire, or in a location near the luminaire. In this manner, the pattern sensing means can acquire a measure of a lighting pattern associated with a corresponding position of the plurality of optical elements. Then, controlling the moving means in function of the acquired measure will enable a more adapted lighting pattern to be achieved relative to the current environment of the luminaire system. Further, acquiring a measure of the surface area associated with the lighting pattern will enable the correlation between a position of the plurality of optical elements and the resulting lighting pattern.

In an embodiment, the controlling means may correct, e.g. regularly or continuously correct, the position of the plurality of optical elements respective to the plurality of light sources based on sensed data or received data, e.g. the data from the pattern sensing means, data from the environment sensing means or data from a sensing means configured to acquire a measure for a position of the second support relative to the first support. It is noted that also data from any sensing means of nearby luminaire systems may be taken into account when correcting the position. For example, if a luminaire is positioned between two other luminaires, the lighting patterns thereof may partially overlap. Further, the data of the environment sensing means located on one luminaire may be used for controlling several neighbour luminaires. The lighting pattern measured by the central luminaire may also be used to correct the position of the plurality of optical elements respective to the plurality of light sources of the other two luminaires.

According to a preferred embodiment, the luminaire system further comprises a driver configured to drive the plurality of light sources; and optionally a dimmer configured to control the driver to drive one or more of the plurality of light sources at a dimmed intensity. In this manner, the energy supplied to the light sources is controlled by the driver. The optional addition of a dimmer would allow obtaining a greater variety of light distributions by varying the light intensity in addition to the positioning of the light sources respective to the optical elements. Preferably, the plurality of light sources is a plurality of LEDs. Moreover, the dimming level may be different from one light source to another.

According to an exemplary embodiment, the controlling means is configured for controlling the moving means and the driver and optionally the dimmer to control the movement, the intensity, the flashing pattern, the light colour and/or the light colour temperature, respectively. Preferably, the controlling means is configured to set a particular position of the first and second optical module relative to the support structure in combination with a light intensity and/or a flashing pattern and/or a light colour and/or a light colour temperature. In the context of the present application "light colour data" can refer to data for controlling a colour (e.g. the amount of red or green or blue) and/or data for controlling a type of white light (e.g. the amount of "cold" white or the amount of "warm" white).

According to an embodiment, the controlling means is further configured for controlling the moving means based on the lighting data received from a remote device. Lighting data may comprise e g dimming data, switching data, pattern data, movement data, light colour data, flashing pattern data, light colour temperature data, etc. For example, the movement data for a particular luminaire may be determined by the remote device based on measurement data measured by one or more luminaires. It is further possible to link the movement data to the light colour data and/or to the dimming data and/or to the light colour temperature data and/or to the flashing pattern data, so that the light colour and/or the light intensity and/or the light colour temperature and/or the flashing pattern is changed during the moving or after the moving.

According to an exemplary embodiment, the moving means comprises a linear actuator, preferably a stepper motor. According to another exemplary embodiment, the moving means comprises a bi-metal. In this way, translational motion of the optical modules relative to the support structure can be carried out.

In the context of this invention, when specifying that a first component is moved "with respect to" or "relative to" a second component, it is implied that the second component and/or the first component may be moved, i.e. the first component may be fixed and the second component may be moved, or the second component may be fixed and the first component may be moved, or both the first and the second component may be moved.

Preferred embodiments relate to a luminaire system of an outdoor luminaire. By outdoor luminaire, it is meant luminaires which are installed on roads, tunnels, industrial plants, campuses, parks, cycle paths, pedestrian paths or in pedestrian zones, for example, and which can be used notably for the lighting an outdoor area, such as roads and residential areas in the public domain, private parking areas, access roads to private building infrastructures, etc.

According to an exemplary embodiment, an optical element has an internal surface facing a light source of the plurality of light sources and an external surface. The internal surface and/or the external surface may comprise a first curved surface and a second curved surface, said first curved surface being connected to said second curved surface through a connecting surface or line comprising a saddle point or discontinuity. The optical elements are movably arranged relative to the support structure to position the light source either in at least a first position facing the first curved surface or in at least a second position facing the second curved surface. When the external surface is implemented as described, preferably the external surface comprises a first outwardly bulging surface, a second outwardly bulging surface, and an external connecting surface or line connecting said first and second outwardly bulging surfaces. However, it is also possible to have a continuous outer surface and to implement only the internal surface as described. When the internal surface is implemented as described, preferably the internal surface comprises a first outwardly bulging surface, a second outwardly bulging surface, and an internal connecting surface or line connecting said first and second outwardly bulging surfaces. The term "outwardly bulging surface" is used here to refer to a surface which bulges outwardly, away from an associated light source. An outwardly bulging external surface forms a protruding portion, whilst an outwardly bulging internal surface forms a cavity facing an associated light source.

By providing such curved surfaces, the optical element is given a "double bulged" shape allowing to generate distinct lighting patterns depending on the position of the light source with respect to the optical element. More in particular, the shape, the size and the location of the light beam may be different depending on the position of the light source with respect to the optical element. This will allow illuminating various types of sites, e.g. various types of roads or paths with the same luminaire head. Also, this will allow adjusting a lighting pattern in function of the height at which the luminaire system is located above the surface to be illuminated.

Preferably, the optical element has a circumferential edge in contact with the support structure (e.g. a PCB), and the internal connecting surface or line is at a distance of the support structure.

Preferably, the first outwardly bulging surface delimits a first internal cavity, the second outwardly bulging surface delimits a second internal cavity, and the internal connecting surface or line delimits a connecting passage between the first and second internal cavity. Such a connecting passage will allow a light source to pass from the first to the second cavity and vice versa.

Preferably, a first maximal width of the first internal cavity, and a second maximal width of the second internal cavity are bigger than a third minimal width of the connecting passage between the first and second internal cavity. The first and second maximal widths and the third minimal width extend in the same plane, in a direction perpendicular to the moving direction. The first and second maximal widths may also be different. The widths are measured in a lower plane of the optical element, delimiting the open side of the cavities, and the maximal width corresponds to a maximal width in this plane.

Preferably, the first curved surface is at a first maximal distance of the support structure, the second curved surface is at a second maximal distance of the support structure, and the saddle point or discontinuity is at a third minimal distance of the support structure, said third minimal distance being lower than said first and second maximal distances. More preferably, the first and second maximal distances are different. Those characteristics may apply for the external and/or internal curved surfaces.

In an exemplary embodiment, the luminaire system is included in a luminaire head having a fixation end configured for being attached to a pole. The first maximal distance defined above is larger than the second maximal distance defined above, and the optical element is arranged such that the first internal and/or external curved surface is closer to the fixation end of the luminaire head than the second internal and/or external curved surface.

In an exemplary embodiment, the optical element further comprises at least one reflective element configured to reflect a portion of the light emitted by the light source, wherein preferably said at least one reflective element comprises a first reflective surface located at a first edge of the first curved surface and a second reflective surface located at a second edge of the first curved surface, wherein the second edge is an edge near the connecting surface or line and the first edge is opposite the second edge, away from the connecting surface or line. Alternatively or additionally, the light source may be provided with a reflective element. By using one or more reflective elements, the light may be directed to the street side of the luminaire in a more optimal manner.

The first and/or second curved surfaces may have a symmetry axis parallel to the moving direction. In an exemplary embodiment, both first and second curved surfaces have a symmetry axis parallel to the moving direction of the optical element. However, it is also possible to design the first curved surfaces with a symmetry axis whilst giving the second curved surfaces an asymmetric design or vice versa, or to design both the first and the second curved surfaces in an asymmetric manner. This will allow to obtain a symmetrical light beam in a first position of the light source relative to the optical element, and to obtain an asymmetrical light beam in a second position of the light source relative to the optical element.

In the examples above an optical element comprises two adjacent curved surfaces bulging outwardly, but the skilled person understands that the same principles can be extended to embodiments with three or more adjacent curved surfaces bulging outwardly. Also, it is possible to provide an optical element with an array of bulged surfaces, e.g. an array of n×m bulged surfaces with n>=1 and m>=1.

BRIEF DESCRIPTION OF THE FIGURES

The accompanying drawings are used to illustrate presently preferred non-limiting exemplary embodiments of systems of the present invention. The above and other advantages of the features and objects of the invention will become more apparent and the invention will be better understood from the following detailed description when read in conjunction with the accompanying drawings, in which.

DETAILED DESCRIPTION OF THE FIGURES

Figure 1A:
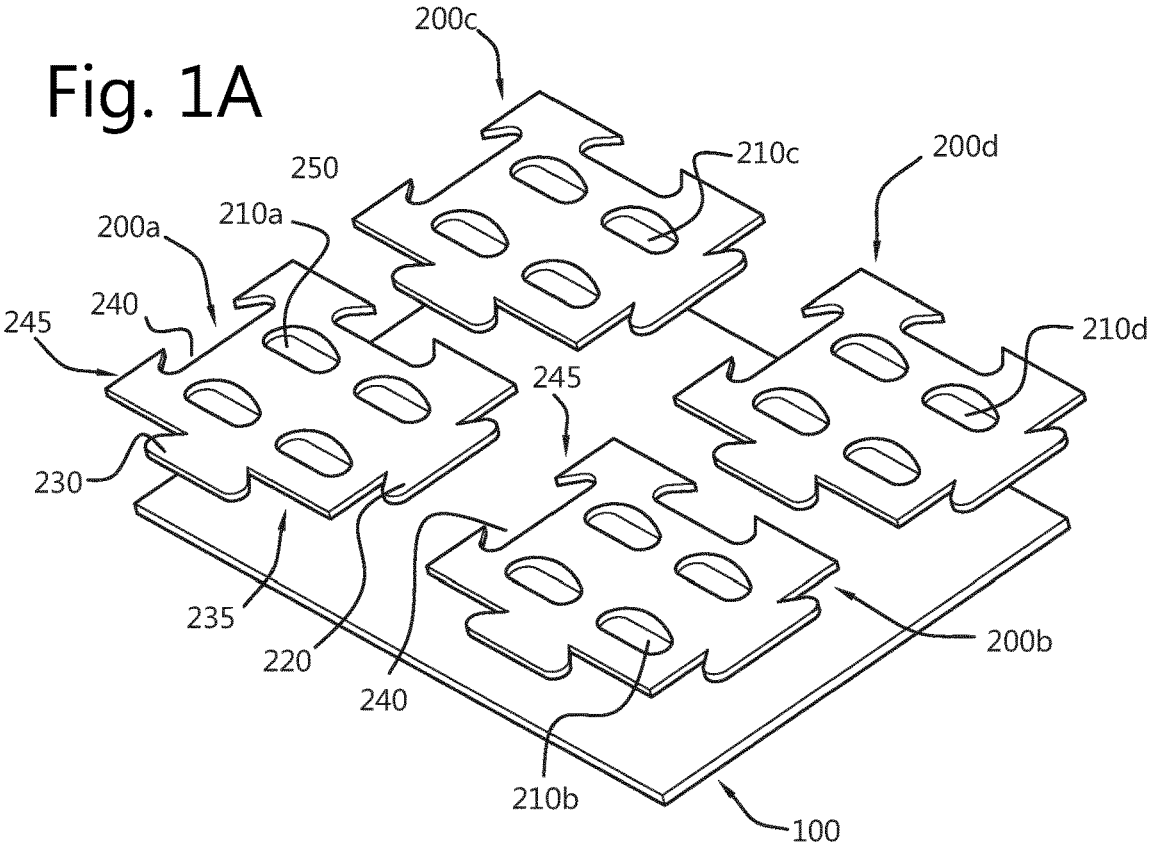
FIG. 1A illustrates a schematic exploded view of an exemplary embodiment of a luminaire system.

Aspects of the present invention will now be described in more detail, with reference to the appended drawings showing currently preferred embodiments of the invention. Like numbers refer to like features throughout the drawings.

Embodiments of a luminaire system of the invention comprise a support structure, a plurality of light sources arranged on the support structure, a plurality of optical modules, and a moving means configured to move the optical modules relative to the support structure. Preferably, the optical modules are movable in a plane which is substantially parallel to the support structure.

The luminaire system typically comprises a luminaire head with a luminaire housing and optionally a luminaire pole. The luminaire head may comprise the support structure, e.g. a PCB and the optical modules, e.g. lens plates. The luminaire head may be connected in any manner known to the skilled person to the luminaire pole. Typical examples of such systems are street lights. In other embodiments, a luminaire head may be connected to a wall or a surface, e.g. for illuminating buildings or tunnels. A luminaire driver may be provided in or on the luminaire head, or in or on a luminaire pole, and more generally anywhere in the luminaire system. The moving means may also be provided in the luminaire head. Also a driver for feeding the moving means may be provided in or on the luminaire head, or in or on a luminaire pole, and more generally anywhere in the luminaire system. The luminaire driver and the driver for the moving means may be the same or distinct.

The support structure may comprise a supporting substrate, e.g. a PCB, and a heat sink onto which the supporting substrate may be mounted, said heat sink being made of a thermally conductive material, e.g. aluminium. Alternatively, the PCB may be mounted directly on the luminaire housing functioning as heat sink. The plurality of light sources may comprise a plurality of LEDs.

Further, each light source may comprise a plurality of LEDs, more particularly a multi-chip of LEDs. The plurality of light sources may be arranged without a determined pattern or in an array with at least two rows of light sources and at least two columns of light sources, typically an array of more than two rows and more than two columns. The surface onto which the plurality of light sources is mounted on can be made reflective or white to improve the light emission. The plurality of light sources could also be light sources other than LEDs, e.g. halogen, incandescent, or fluorescent lamps.

Each optical module may comprise one or more optical elements, typically lens elements, associated with the plurality of light sources. Indeed, lens elements may be typically encountered in outdoor luminaire systems, although other types of optical elements may be additionally or alternatively present in such luminaires, such as reflectors, backlights, prisms, collimators, diffusors, and the like. The plurality of optical elements may be mounted such that each of the plurality of light sources is arranged opposite an optical element. In the exemplary embodiment shown in the figures, the optical elements are lens elements which are similar in size and shape and there is one lens element for each light source. In another exemplary embodiment, some or all of the optical elements may be different from each other. In a further exemplary embodiment, there may be more optical elements than light sources, and the optical modules may be movable such that a light source can be moved from a position opposite a first optical element to a position opposite a second optical element. In other embodiments, there may be provided a plurality of LEDs opposite some or all of the optical elements. The lens elements may be in a transparent or translucent material. They may be in optical grade silicone, glass, poly(methyl methacrylate) (PMMA), polycarbonate (PC), or polyethylene terephthalate (PET).

Figure 1B:
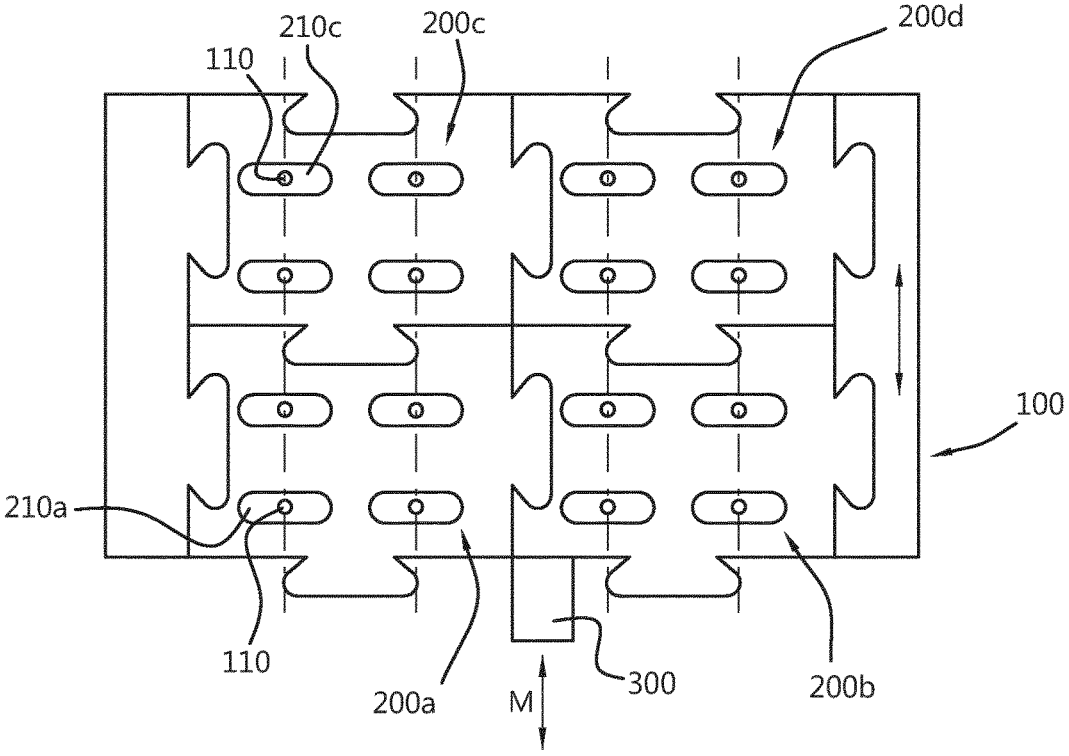
FIG. 1B illustrates a top view of the luminaire system of FIG. 1A.

FIGS. 1A and 1B illustrate a first exemplary embodiment of a luminaire system comprising a support structure 100 and a plurality of optical modules 200*a*, 200*b*, 200*c*, 200*d*. As shown in FIG. 1B, a plurality of light sources 110 is arranged on the support structure 100. The support structure 100 may comprise one or more PCBs. For convenience, the support structure 100 is shown in FIGS. 1A and 1B as a single plate, but the skilled person understands that the support structure 100 may also be formed with a plurality of PCBs. Each optical module 200*a*, 200*b*, 200*c*, 200*d* is provided with a plurality of optical elements 210*a*, 210*b*, 210*c*, 210*d*, here four optical elements arranged in an array of two columns and two rows. The optical modules 200*a*, 200*b*, 200*c*, 200*d* are configured for being interlocked with respect to each other. As shown in FIG. 1B, the luminaire system further comprises a moving means 300 configured to move the optical module 200*b* in a moving direction M. The moving can be any translation, e.g. along a straight and/or along curved line, optionally combined with a rotation. In that manner, a position of the optical module 200*b* with respect to the support structure 100 is changed. Because all optical modules 200*a*, 200*b*, 200*c*, 200*d* are interlocked, the movement of the optical module 200*b* in the moving direction M will cause a movement of the other optical modules 200*a*, 200*c*, 200*d* in the moving direction M. In the embodiment of FIGS. 1A and 1B, the optical modules 200*a-d* may be arranged to be in contact with the support structure 100 during the moving.

Each optical module 200*a*, 200*b*, 200*c*, 200*d* is an integrally formed element in the form of a plate with the optical elements 210*a*, 210*b*, 210*c*, 210*d*, two protrusions 220, 230 and two recesses 240, 250 being integrally formed in the plate. It is noted that more or less protrusions and recesses may be provided depending on the desired interlocking. For example, if the optical modules are positioned in a single row or column, only one protrusion and recess may be provided. Preferably, each optical module 200*a*, 200*b*, 200*c*, 200*d* is moulded in one piece, preferably of the same material. The optical elements may be lens elements. Further, it should be clear for the skilled person that the one or more optical elements 210*a*, 210*b*, 210*c*, 210*d* may additionally or alternatively comprise other elements than lens elements, such as, reflectors, backlight elements, collimators, diffusors, and the like. A lens element may be free form in the sense that it is not rotation symmetric. In the embodiment of FIGS. 1A and 1B, the lens elements 210*a*, 210*b*, 210*c*, 210*d* have a symmetry axis. In another embodiment, the lens elements 210*a*, 210*b*, 210*c*, 210*d* may have no symmetry plane/axis. Each optical module 200*a-d* including the one or more optical elements 210*a-d* and the one or more interlocking elements 220, 230, 240, 250 may be moulded in a transparent or translucent material. The optical module 200*a-d* may be e.g. in optical grade silicone, glass, poly (methyl methacrylate) (PMMA), polycarbonate (PC), or polyethylene terephthalate (PET). Optionally a reflective coating may be provided on a portion of the optical module.

An edge 225 of an optical module 200*a* has a shape which is complementary to an edge 245 of an adjacent optical module 200*b*, such that said edges 225, 245 can cooperate in an interlocking manner. An optical module 200*a-d* may have one, two, three or more edges which are provided with an interlocking element. In the illustrated embodiment, each optical module 200*a-d* has a first edge 225 with a first interlocking element in the form of a protrusion 220, a second edge 235 with a second interlocking element in the form of a protrusion 230, a third edge 245 with a third interlocking element in the form of a recess 240, and a fourth edge 255 with a fourth interlocking element in the form of a recess 250. The optical modules 200*a-d* are configured to cause an interlocking in two dimensions in a plane parallel to the support structure 100. An optical module 200*a*, 200*b*, 200*c*, 200*d* is connected to an adjacent optical module through one or more dovetail connections 220, 240; 230, 250. In FIGS. 1A and 1B, the optical elements 210*a-d* are identical but in other embodiments the optical elements 210*a-d* may be different. Also, a plurality of different optical elements 210*a* could be combined within the same optical module 200*a*.

Figure 2:
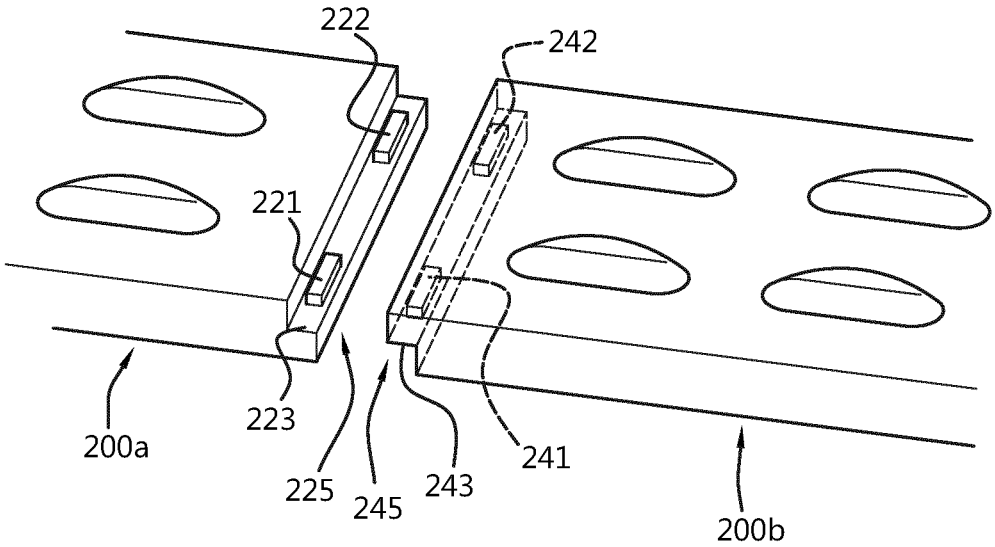
FIG. 2 illustrates an exemplary embodiment of an optical module for use in a luminaire system.

FIG. 2 illustrates another exemplary embodiment of an optical module 200*a-b* for use in a luminaire system. In this embodiment, the optical modules 200*a-b* are configured to cause an interlocking in three dimensions. To that end an edge 225 of optical module 200*a* has a shape which is complementary to a shape of an edge 245 of optical module 200*b*, and the shape is such that an interlocking in three dimensions is achieved. In the exemplary embodiment of FIG. 2, the edges 225, 245 are formed with complementary steps 223, 243. Step 223 is provided with protrusions 221, 222 configured to be received in recesses 241, 242 provided in step 243. It is noted that many variants exist and that more or less protrusions/recesses/steps may be provided depending on the desired degree of interlocking.

Figure 3A:
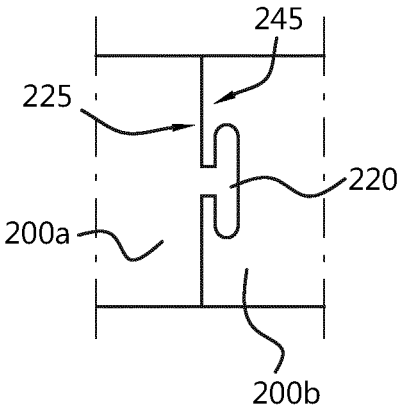
FIGS. 3A, 3B and 3C illustrate schematically interlocking edges of exemplary embodiments of optical modules.
Figure 3B:
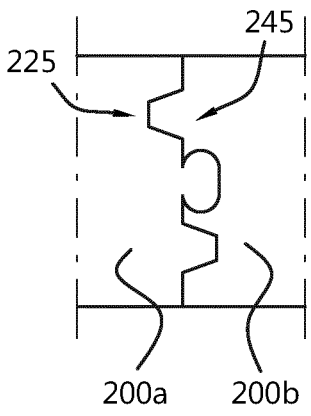
Figure 3C:
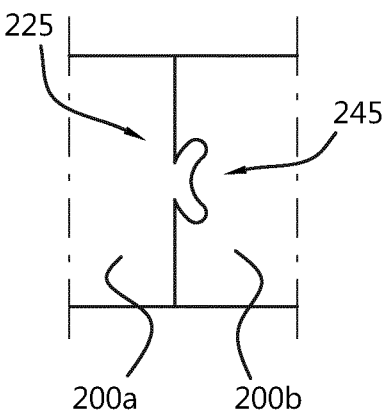

FIGS. 3A, 3B and 3C illustrate schematically interlocking edges of exemplary embodiments of optical modules. As shown in FIGS. 3A, 3B and 3C many different shapes are possible for the interlocking edges 225, 245 of adjacent optical modules 200*a*, 200*b*.

Figure 4:
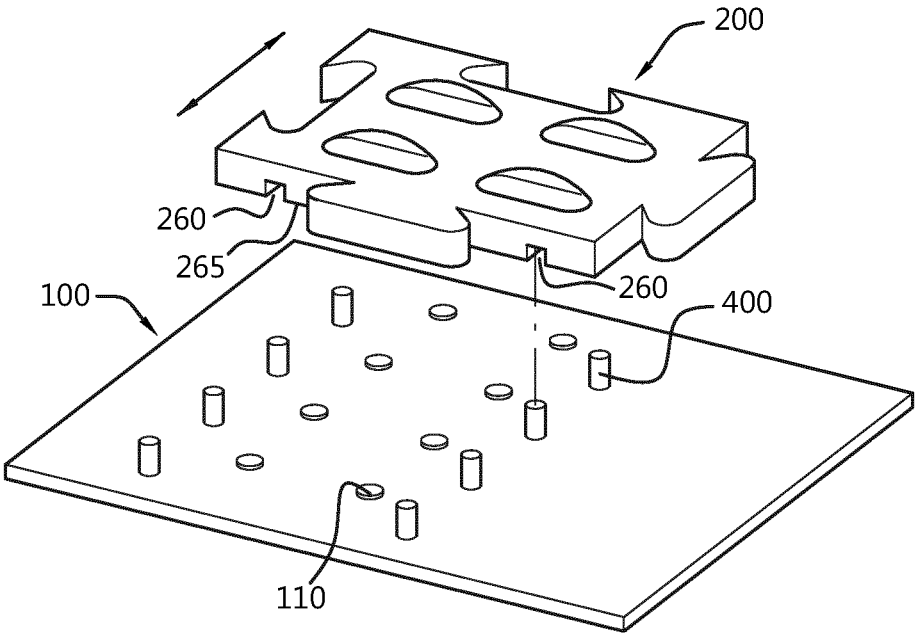
FIG. 4 illustrates an exploded view of another exemplary embodiment of a luminaire system, wherein for reasons of simplicity only one optical module is shown.

FIG. 4 illustrates an exploded view of another exemplary embodiment of a luminaire system, wherein for reasons of simplicity only one optical module 200 is shown. The optical modules 200 are arranged to move at a distance of the support structure 100, e.g. a PCB. The support structure 100 is provided with a plurality of distance elements 400 on which the optical modules 200 are movably supported. Optionally, a surface 265 of the optical modules 200 facing the support structure 100 may be provided with one or more tracks or guides 260 cooperating with the distance elements 400. Such tracks or guides 260 may be formed integrally with the rest of the optical module 200. Optionally, the distance elements 400 may be adjustable in order to adjust the distance between the support structure 100 and the optical module 200. For example, the distance elements 400 may comprise a screw thread cooperating with a bore arranged in/on the support structure 100.

Figure 5:
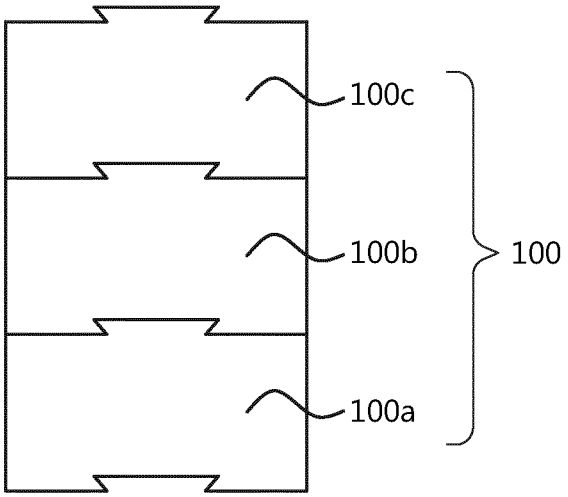
FIG. 5 illustrates a top view of an exemplary embodiment of a support structure comprising a plurality of PCBs.

FIG. 5 illustrates a top view of an exemplary embodiment of a support structure 100 comprising a plurality of PCB's 100*a*, 100*b*, 100*c*. The plurality of PCB's 100*a*, 100*b*, 100*c* are interlocked with respect to each other in a direction parallel to the moving direction. The PCB's may be interlocked in the same manner as described above for the optical modules 200, e.g. using dovetail connections as illustrated in FIG. 5.

In the example of FIGS. 1A and 1B one moving means 300 is provided for four optical modules 200*a-d*. It is also possible to provide one moving means 300 for two, three or more than four optical modules. Further, it is possible to add one or more further optical modules, and a further moving means configured to move the one or more further optical modules relative to the support structure.

Figure 7A:
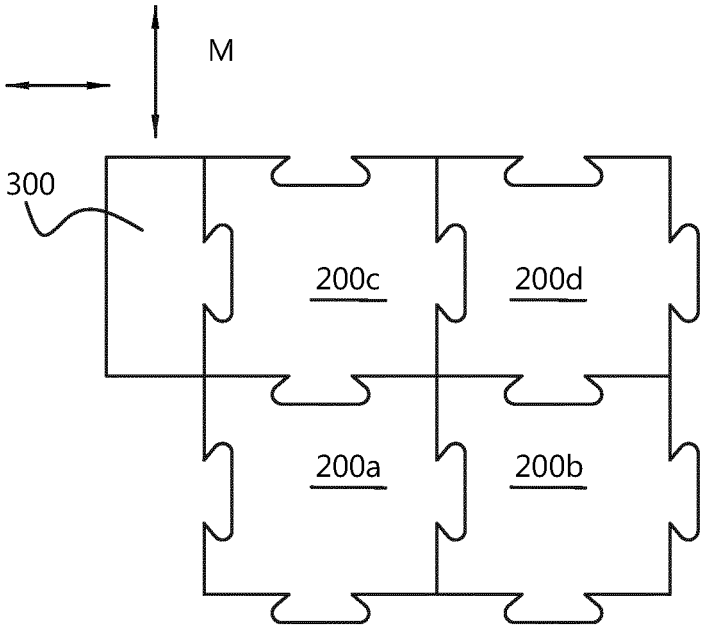
FIGS. 7A-7C illustrate three exemplary embodiments illustrating possible connections between the moving means and the optical modules.
Figure 7B:
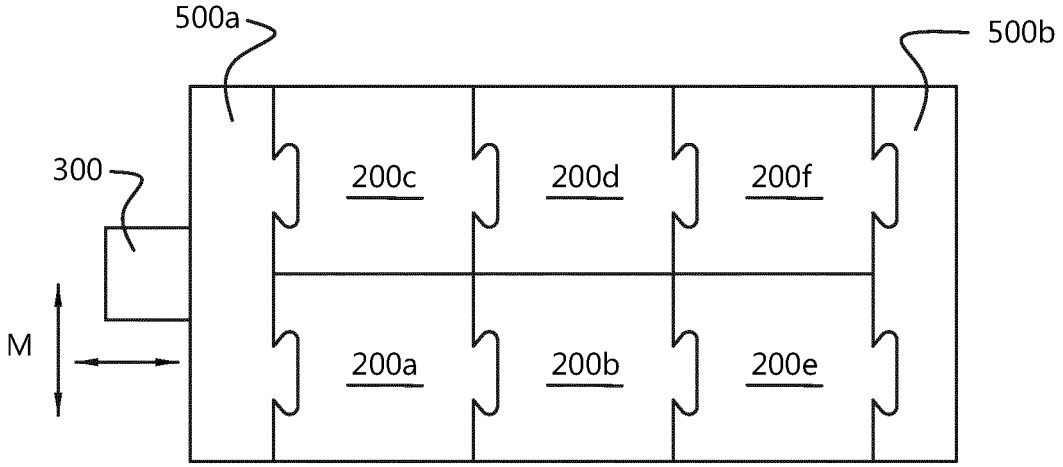
Figure 7C:
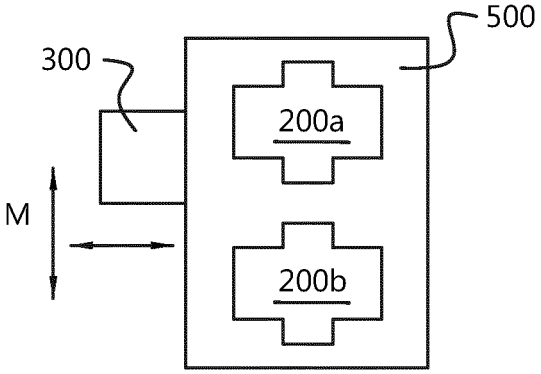

FIGS. 7A-7C illustrate three possibilities for connecting the moving means 300 to the optical modules 200*a*, 200*b*, etc. In the embodiment of FIG. 7A, the moving means 300 are directly connected to one of the optical modules, here optical module 200*c*. By moving optical module 200*c* in a movement direction M, also the other optical modules 200*a*, 200*b*, 200*d* are moved in the movement direction M.

In the embodiment of FIG. 7B, the first and the second optical module 200*a*, 200*c* are interlocked with a frame portion 500*a*, such that said first and second optical module are interlocked with respect to each other in a moving direction M. A moving means 300 is connected to the frame portion 500*a* in order to move the interconnected optical modules 200*a*, 200*b*, 200*c*, 200*d*, 200*e*, 200*f*. The optical modules 200*a*, 200*b*, 200*e* are arranged in a first row, and the optical modules 200*c*, 200*d*, 200*f* are arranged in a second row, such that an array of optical modules is formed. The frame portion 500*a* connects a first row of optical modules 200*a*, 200*b*, 200*e* to a second row of optical modules 200*c*, 200*d*, 200*f*. Further, there may be provided a second frame portion 500*b* connecting the first row to the second row at another end of the rows. The skilled person understands that the frame portions 500*a*, 500*b* could also interconnect more than two optical modules.

In the embodiment of FIG. 7C, a first optical module 200*a* and a second optical module 200*b* are arranged in a frame 500, and a moving means 300 is connected to the frame 500 in order to move the first and second optical module 200*a*, 200*b* in a moving direction M. The skilled person understands that also more than two optical modules may be arranged in a frame 500.

Figure 6:
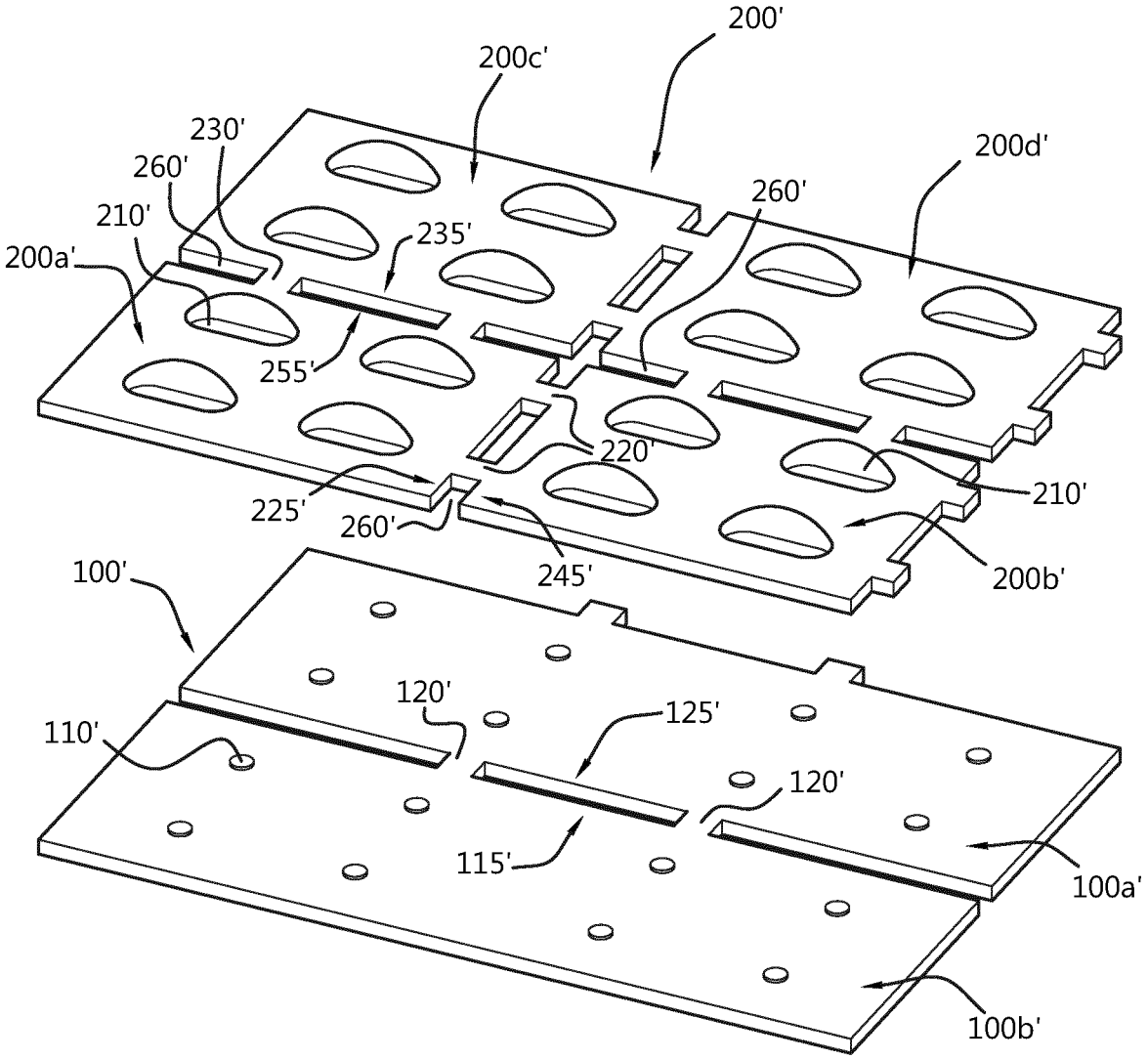
FIG. 6 illustrates a schematic exploded view of another exemplary embodiment of a luminaire system.

FIG. 6 illustrates an exploded view of another exemplary luminaire system. The luminaire system comprises a support structure 100', a plurality of light sources 110' arranged on the support structure 100', and an optical structure 200' provided with a plurality of optical elements 210'. In this embodiment, the support structure 100' is an integral plate-like structure comprising a plurality of plate-like elements 100*a*'-b' having adjacent edges 115', 125' which are interconnected with each other via one or more integral interconnecting elements 120'. The one or more integral interconnecting elements 120' are configured for allowing and guiding a separating of adjacent plate-like elements 100*a*', 100*b*'. Also, the optical structure 200' is an integral plate-like structure comprising a plurality of plate-like elements 200*a*'-d' having adjacent edges 225', 245'; 235', 255' which are interconnected with each other via one or more integral interconnecting elements 220'; 230'. The one or more integral interconnecting elements 220', 230' are configured for allowing and guiding a separating of adjacent plate-like elements 200*a*'-d'. It is noted that it is also possible to combine the support structure 100' with any one of the previously described optical modules 200*a-d*, 200 instead of with the optical structure 200'. Also, it is possible to combine the optical structure 200' with any one of the support structures 100 described above instead of with the support structure 100'.

Although not illustrated, in a similar manner as shown in FIG. 1B, the system of FIG. 6 may further comprise a moving means configured to move the optical structure 200' relative to the support structure 100', such that a position of the optical structure 200' with respect to the support structure 100' can be changed. It is noted that either the optical structure 200' or the support structure 100' or both may be moved to realize the relative movement of the optical structure 200' relative to the support structure 100'.

The support structure 100' may be manufactured by cutting a PCB such as a PCBA, into a plurality of plate-like elements 100*a*'-*b*' such that adjacent edges 115', 125' of the plate-like elements are interconnected with each other via one or more integral interconnecting elements 120'. This may be achieved by cutting away a plurality of rectangular portions to form the blanks 260' and one or more bar-shaped interconnecting elements 120' between the adjacent edges 115', 125' of the plate-like elements 100*a*'-*b*'. Alternatively, grooves may be arranged between adjacent edges 115', 125' of the plate-like elements 100*a*'-b' such that thin interconnecting plates are formed. Optionally, one or more plate-like elements 100*a*' may be removed by breaking one or more interconnecting elements 120' in order to obtain a support structure 100' with a desired number of plate-like elements 100*a*'-*b*'. In FIG. 6 only two plate-like elements 100*a*'-b' are shown, but the skilled person understands that the support structure may comprise many more plate-like elements.

The optical structure 200' may be manufactured by cutting an optical base structure into a plurality of plate-like elements 200*a*'-d' or moulding an integral optical base structure with a plurality of plate-like elements 200*a*'-d', such that adjacent edges 225', 245'; 235', 255' of the plate-like elements 200*a*'-d' are interconnected with each other via one or more integral interconnecting elements 220'; 230', and optionally removing one or more plate-like elements 200*a*'-d' from the optical base structure by breaking one or more interconnecting elements 220', 230' in order to obtain an optical structure 200' with a desired number of plate-like elements.

FIGS. 8A-8E illustrate in more detail another embodiment of a "double bulged" lens element suitable for use in embodiments of the invention. For example, such lens element may be included in an optical module. The lens element 210 of FIGS. 8A-8E has an internal surface 210*i* facing a light source 110 and an external surface 210*e*. The internal surface 210I comprises a first curved surface 211*b* in the form of a first outwardly bulging surface and a second curved surface 212*b* in the form of a second outwardly bulging surface. The first curved surface 211*b* is connected to the second curved surface 212*b* through an internal connecting surface or line 213*b* comprising a saddle point or discontinuity. The external surface 210*e* comprises a first curved surface 211*a* in the form of a first outwardly bulging surface and a second curved surface 212 in the form of a second outwardly bulging surface. The first curved surface 211*a* is connected to the second curved surface 212*a* through an external connecting surface or line 213*a* comprising a saddle point or discontinuity. The second support 200 is movable relative to said first support 100 such that the light source 110 can be in at least a first position P1 facing the first curved surfaces 211*a*, 211*b* or in at least a second position P2 facing the second curved surfaces 212*a*, 212*b*. The lens element 210 has a circumferential edge 218 in contact with the first support 100, and the internal connecting surface or line 213*b* is at a distance of the first support 100. In other words the lens element 210 moves in contact with the first support 100, and the distance between the internal connecting surface or line 213*b* and the first support allows the light source to pass underneath the connecting surface or line 213*b* when the second support 200 is moved from a first position where the light source 110 faces the first curved surfaces 211*a*, 211*b* to a second position where the light source 110 faces the second curved surfaces 212*a*, 212*b*. As is best visible in FIG. 8B, the external connecting surface 213*a* comprises a "line" portion in a central part, and two "surface" portions on either side of the "line" portion. Optionally, the external connecting surface 213*b* may be covered partially with a reflective coating, e.g. the hatched "surface" portions in the top view of FIG. 8B may be provided with a reflective coating.

Figure 8A:
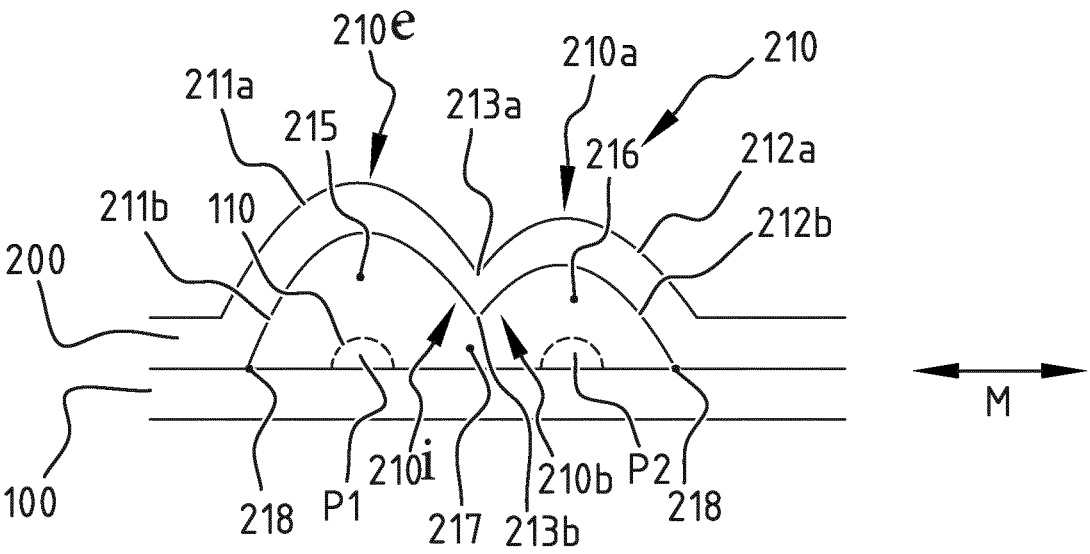
FIG. 8A shows a schematic cross-sectional view of another exemplary embodiment of a lens element for use in an optical module.
Figure 8B:
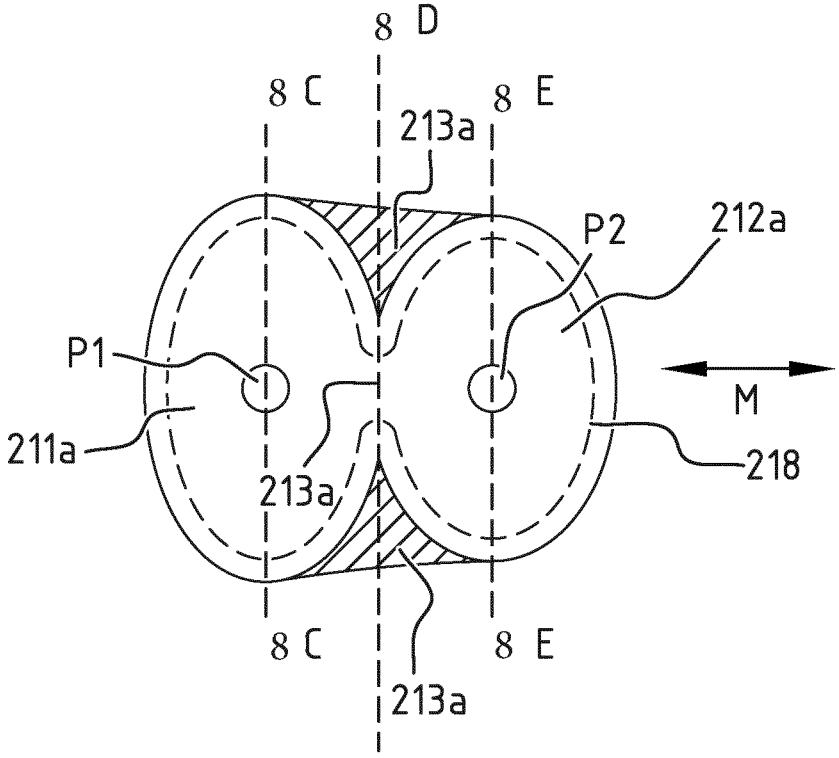
FIG. 8B shows a schematic top view of the lens element of FIG. 8A.
Figure 8C:
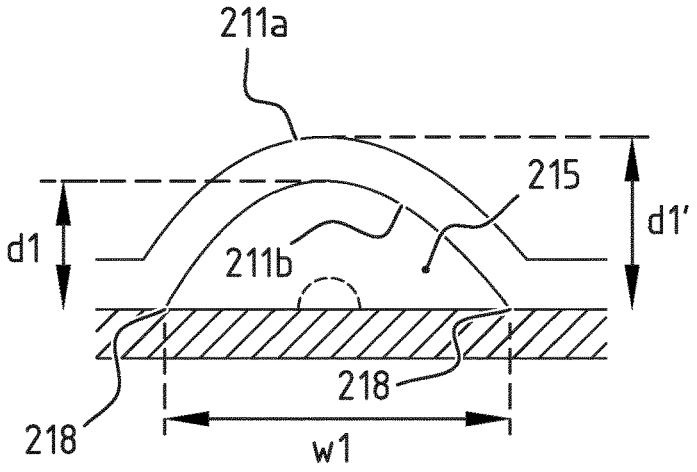
FIGS. 8C, 8D, 8E are schematic cross-sectional views of the lens element along lines 8C-8C, 8D-8D, 8E-8E shown in FIG. 8B.
Figure 8D:
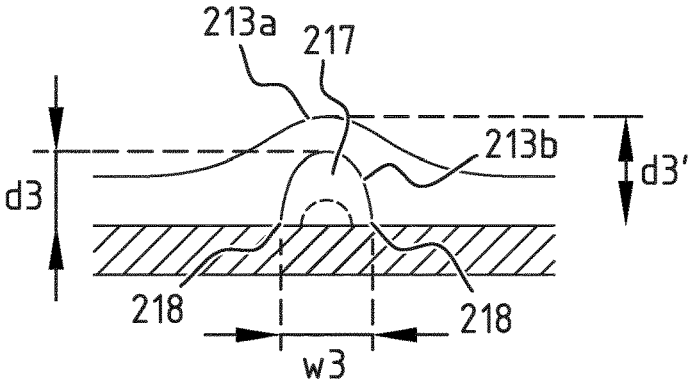
Figure 8E:
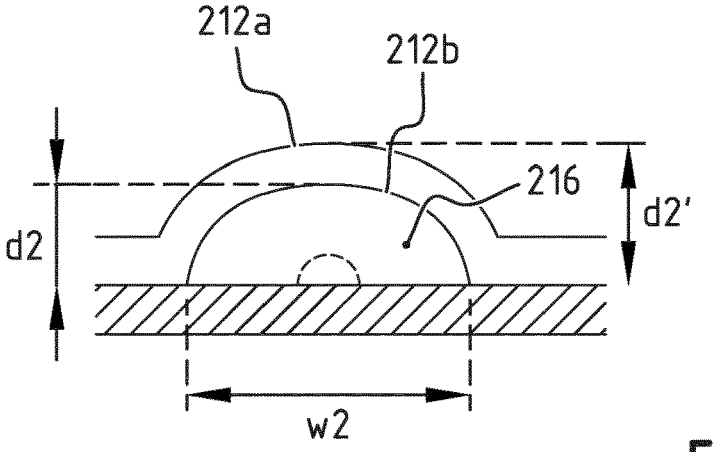

The first outwardly bulging surface 211*b* and the first support 100 delimit a first internal cavity 215, the second outwardly bulging surface 212*b* and the first support 100 delimit a second internal cavity 216, and the internal connecting surface or line 213*b* and the first support 100 delimit a connecting passage 217 between the first and second internal cavity. FIG. 8C shows a cross section along line 8C-8C in FIG. 8B, and illustrates that the first internal cavity 215 has a first maximal width w1, said first maximal width extending in a direction perpendicular on the moving direction M and measured in an upper plane of the first support 100. Similarly, FIG. 8D shows a cross section along line 8D-8D in FIG. 8B, and illustrates that the second internal cavity 216 has a second maximal width w2. FIG. 8E shows a cross section along line 8E-8E in FIG. 8B, and illustrates that the connecting passage 217 has a third minimal width w3. The first maximal width w1 and the second maximal width w2 are preferably larger than the third width w3. Also, the first maximal width w1 and the second maximal width w2 may be different. The first outwardly bulging surface 211*b* is at a first maximal distance d1 of the first support 100, the second outwardly bulging surface 212*b* is at a second maximal distance d2 of the first support 100, and the internal saddle point or discontinuity is at a third minimal distance d3 of the first support 100. The third minimal distance d3 may be lower than said first and second maximal distance d1, d2. Preferably, the first and second maximal distance d1, d2 are different. Similarly, the first outwardly bulging surface 211*a* is at a first maximal distance d1' of the first support 100, the second outwardly bulging surface 212*a* is at a second maximal distance d2' of the first support 100, and the external saddle point or discontinuity is at a third minimal distance d3' of the first support 100. The third minimal distance d3' may be lower than the first and second maximal distance d1', d2'. Preferably, the first and second maximal distance d1', d2' are different.

Whilst the principles of the invention have been set out above in connection with specific embodiments, it is to be understood that this description is merely made by way of example and not as a limitation of the scope of protection which is determined by the appended claims.

The invention claimed is:

1. A luminaire system comprising:

a support structure;

a plurality of light sources arranged on the support structure;

at least a first and second optical module, said first optical module being provided with at least one first optical element and said second optical module being provided with at least one second optical element, said first and second optical module being configured for being interlocked with respect to each other along a moving direction such as to move together in any direction along the moving direction; and one of one or more actuators configured to move the first optical module relative to the support structure in any direction along the moving direction, such that a position of the first and second optical module with respect to the support structure is changed.

2. The luminaire system according to claim 1, wherein the first optical module is an integrally formed element in which the at least one first optical element is integrally formed, and the second optical module is an integrally formed element in which the at least one second optical element is integrally formed.

3. The luminaire system according to claim 1, wherein an edge of the first optical module has a shape which is complementary to an edge of the second optical module, such that said edges can cooperate in an interlocking manner.

4. The luminaire system according to claim 1, wherein the first and the second optical module are configured to cause an interlocking in two dimensions in a plane parallel to the support structure and/or wherein the first and the second optical module are configured to cause an interlocking in three dimensions.

5. The luminaire system according to claim 1, wherein the first optical module is connected to the second optical module through a dovetail connection.

6. The luminaire system according to claim 1, wherein the first and the second optical module are interlocked with a frame portion such that said first and second optical module are interlocked with respect to each other in a moving direction through said frame portion, and wherein the one or more actuators are connected to the frame portion in order to move the first and second optical module.

7. The luminaire system according to claim 1, wherein the one or more actuators are directly connected to the first or second optical module; or wherein the first optical module is connected to a frame portion, and wherein the one or more actuators are connected to the frame portion in order to move the first and second optical module.

8. The luminaire system according to claim 1, wherein the first optical module and/or the second optical module is an optical plate integrating one or more of optical elements.

9. The luminaire system according to claim 8, wherein each optical element is associated with a light source of the plurality of light sources.

10. The luminaire system according to claim 1, wherein the support structure comprises at least one PCB.

11. The luminaire system according to claim 10, wherein the support structure comprises a plurality of PCBs which are interlocked with respect to each other.

12. The luminaire system according to claim 10, wherein the first and the second optical module are arranged to move while staying in contact with the at least one PCB; or wherein the first and the second optical module are arranged to move while staying at a distance above the at least one PCB.

13. The luminaire system according to claim 1, wherein the at least one first optical element is different from the at least one second optical element.

14. The luminaire system according to claim 1, further comprising at least one further optical module provided with at least one further optical element, and further one or more actuators configured to move the at least one further optical module relative to the support structure.

15. The luminaire system according to claim 1, wherein the plurality of light sources are arranged in a two dimensional array of at least two rows and at least two columns.

16. The luminaire system according to claim 1, wherein the at least one first optical element consists of at least four optical elements arranged in a two dimensional array of at least two rows and at least two columns, and/or wherein the at least one second optical element consists of at least four optical elements arranged in a two dimensional array of at least two rows and at least two columns.

17. The luminaire system according to claim 1, further comprising a driver configured to drive the plurality of light sources.

18. A luminaire system comprising:

a support structure;

a plurality of light sources arranged on the support structure; and at least a first and second optical module, said first optical module being provided with at least one first optical element and said second optical module being provided with at least one second optical element, said first and second optical module being configured for being interlocked with respect to each other and when interlocked, said first and second optical module being configured for translating together relative to the support structure in a translation direction, said translation direction being in a plane parallel to the support structure, wherein the support structure comprises at least one PCB, and wherein the first and the second optical module are arranged to translate while staying in contact with the at least one PCB.

19. A luminaire system comprising:

a support structure;

a plurality of light sources arranged on the support structure; and at least a first and second optical module, said first optical module being provided with at least one first optical element and said second optical module being provided with at least one second optical element, said first and second optical module being configured for being interlocked with respect to each other and when interlocked, said first and second optical module being configured for moving together relative to the support structure in a moving direction, said moving direction being in a plane parallel to the support structure, wherein the first optical module and/or the second optical module is an optical plate integrating a plurality of optical elements.

* * * * *